US009250568B1

(12) United States Patent
Takenaka

(10) Patent No.: US 9,250,568 B1
(45) Date of Patent: Feb. 2, 2016

(54) IMAGE FORMING APPARATUS AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Sunao Takenaka, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/561,383

(22) Filed: Dec. 5, 2014

(51) Int. Cl.
*G03G 15/08* (2006.01)
*G03G 15/09* (2006.01)
*G03G 15/095* (2006.01)

(52) U.S. Cl.
CPC ..... *G03G 15/0831* (2013.01); *G03G 15/095* (2013.01)

(58) Field of Classification Search
CPC ..... G03G 15/0824; G03G 15/0849; G03G 15/0844
See application file for complete search history.

(56) References Cited

U.S. PATENT DOCUMENTS

2010/0104300 A1* 4/2010 Shinohara ..... 399/43
2011/0064430 A1 3/2011 Mitamura et al.
2012/0082471 A1* 4/2012 Terada ..... 399/53

FOREIGN PATENT DOCUMENTS

JP 2007086174 A * 4/2007

OTHER PUBLICATIONS

Machine translation of JP 2007/086174 A obtained on May 22, 2015.*

* cited by examiner

*Primary Examiner* — Gregory H Curran
(74) *Attorney, Agent, or Firm* — Amin, Turocy & Watson, LLP

(57) ABSTRACT

In accordance with one embodiment, an image forming apparatus comprises a developing device, a control section and a cleaner. The developing device stores decolorable toner and develops a latent image formed on a photoconductor with the decolorable toner. The control section forms a predetermined toner image on the photoconductor by the developing device after driving the developing device without adhering the decolorable toner on the photoconductor. The cleaner collects the toner image.

6 Claims, 10 Drawing Sheets

IMAGE FORMING APPARATUS AND IMAGE FORMING METHOD

FIELD

Embodiments described herein relate generally to an image forming apparatus and an image forming method.

BACKGROUND

Conventionally, there is an image forming apparatus having a function of decoloring an image formed on paper. For example, the image forming apparatus heats the paper printed with decolorable toner to a certain temperature to decolor the image on the paper. In this way, the image forming apparatus makes the paper printed with the decolorable toner reusable.

Generally, developing agent obtained by mixing the decolorable toner with magnetic carrier is used in an image forming apparatus. When the developing agent is stirred, the decolorable toner may be contaminated due to the magnetic carrier. In a case in which printing is carried out on paper with the contaminated decolorable toner, the color may be left on the paper without being decolored even if the paper is heated to the certain temperature.

DETAILED DESCRIPTION

In accordance with one embodiment, an image forming apparatus comprises a developing device configured to store decolorable toner and to develop a latent image formed on a photoconductor with the decolorable toner, a control section configured to form a predetermined toner image on the photoconductor by the developing device after driving the developing device without adhering the decolorable toner on the photoconductor; and a cleaner configured to collect the predetermined toner image formed on the photoconductor.

In accordance with another embodiment, an image forming apparatus comprises a developing device configured to store decolorable toner and to develop a latent image formed on a photoconductor with the decolorable toner, a control section configured to form a predetermined toner image on the photoconductor by the developing device based on a parameter indicating a deterioration degree of the decolorable toner, a cleaner configured to collect the predetermined toner image formed on the photoconductor.

A First Embodiment

Figure 1:
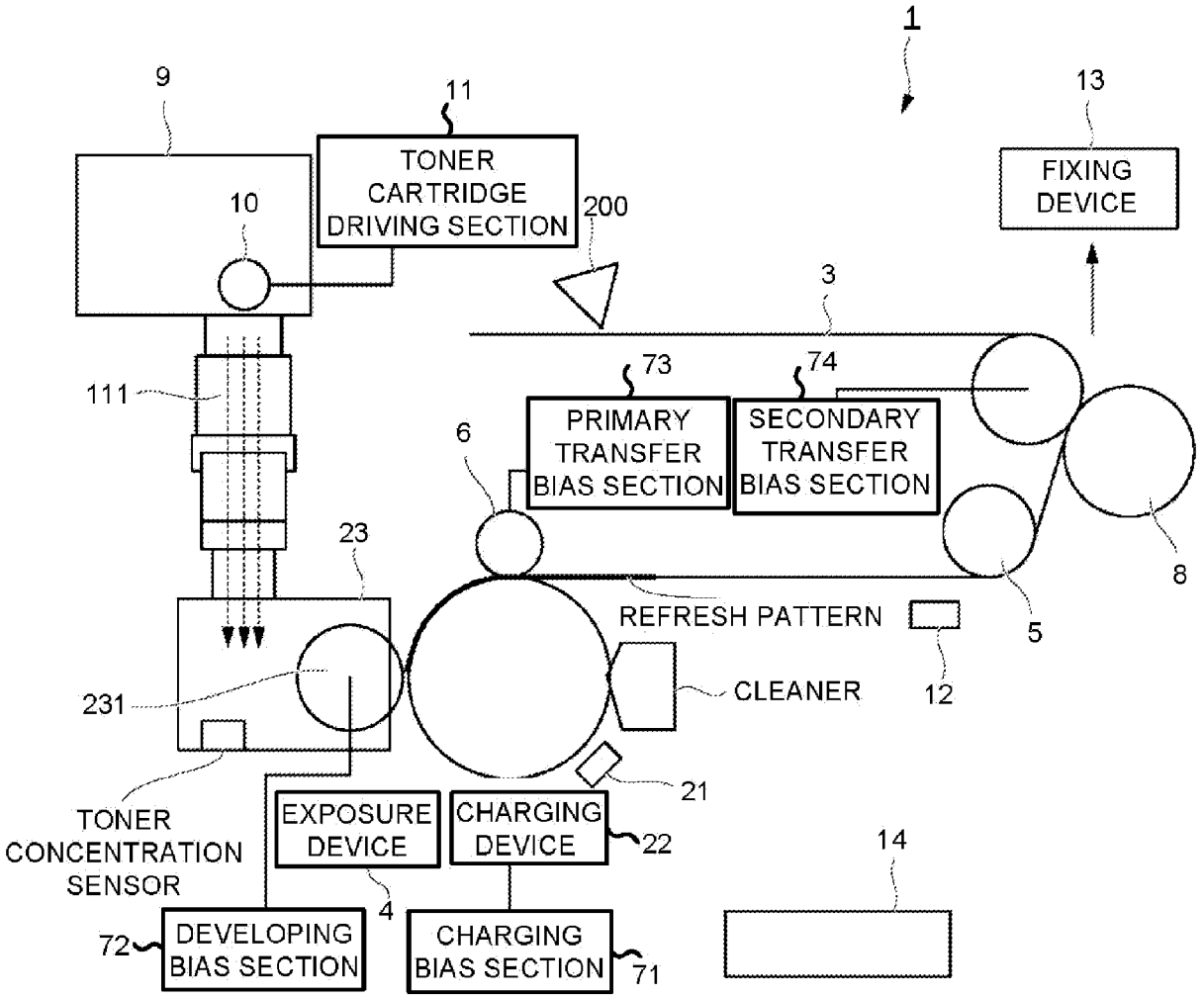
FIG. 1 is a diagram illustrating an example of the constitution of an image forming apparatus according to a first embodiment.

Hereinafter, an image forming apparatus according to the first embodiment is described with reference to the accompanying drawings. FIG. 1 is a diagram illustrating an example of the constitution of an image forming apparatus 1 according to the embodiment. The image forming apparatus 1 is an intermediate transfer type image forming apparatus.

The image forming apparatus 1 includes an image forming section 2, an intermediate transfer belt 3, an exposure device 4, a tension roller 5, a primary transfer roller 6, a power source part 7, a secondary transfer roller 8, a toner cartridge 9, a toner replenishment path 111, a toner adhesion amount sensor 12, a fixing device 13 and a control section 14.

The image forming section 2 includes a photoconductive drum 21, a charging device 22 and a developing device 23.

The photoconductive drum 21 includes an organic photo conductor (OPC) at the surface thereof.

The charging device 22 uniformly charges the surface of the photoconductive drum 21. For example, the charging device 22 is a scorotron type corona charger.

The developing device 23 includes a developing roller 231 in which developing agent is stored. The developing agent is a mixture of decolorable toner and magnetic carrier. The control section 14 controls the concentration of the decolorable toner in the developing agent through the developing device toner concentration sensor 232 in the developing device. The image formed with the decolorable toner is decolored when heating to a temperature higher than the temperature applied in the fixing processing. For example, the decolorable toner includes color generation compound, color developing agent and decoloring agent. For example, the core agent of the magnetic carrier is Mn—Mg ferrite. The coating agent of the magnetic carrier has charging capability against toner. For example, silicone-based resin and the like are used as the coating agent of the magnetic carrier. Further, conductive agent for adjusting the electric resistance of the carrier is contained in the coating agent. For example, carbon black is used as the conductive agent.

The developing roller 231 is applied with a developing bias from the power source part 7. Through the developing bias, the developing agent is supplied to the photoconductive drum 21. Then an electrostatic latent image formed on the photoconductive drum 21 by the exposure device 4 is formed as a toner image.

The intermediate transfer belt 3 is contacted with the primary transfer roller 6. The intermediate transfer belt 3 is stretched by the tension roller 5.

The exposure device 4 acquires image data from the control section 14. The exposure device 4 irradiates the photoconductive drum 21 with laser light corresponding to the acquired image data. The exposure device 4 scans the laser light in an axis direction of the photoconductive drum 21.

Through the scanning and exposure of the laser light, the electrostatic latent image is formed on the photoconductive drum 21.

The primary transfer roller 6 is a conductive roller. The primary transfer roller 6 faces the photoconductive drum 21 across the intermediate transfer belt 3. The primary transfer roller 6 is contacted with the photoconductive drum 21 in pressure across the intermediate transfer belt 3. Further, a transfer bias voltage from the power source part 7 is applied to the primary transfer roller 6. In this way, the toner image is transferred (primarily transferred) to the intermediate transfer belt 3.

The secondary transfer roller 8 is a conductive roller. A given secondary transfer bias voltage from the power source part 7 is applied to the secondary transfer roller 8. In this way, the secondary transfer roller 8 transfers (secondarily transfers) the toner image on the intermediate transfer belt 3 to the paper. After the secondary transfer is completed, the intermediate transfer belt 3 is cleaned by a belt cleaner (not shown).

The toner cartridge 9 is connected with the developing device 23 through the toner replenishment path 111. The toner cartridge 9 stores the decolorable toner. The toner cartridge 9 is provided with an auger 10.

The auger 10 is connected with a toner cartridge driving section 11. The driving force from the toner cartridge driving section 11 is supplied to the auger 10. The developing device toner concentration sensor 232 is arranged inside the developing device 23. The developing device toner concentration sensor 232 outputs a signal corresponding to the toner concentration in the developing device 23 to the control section 14. The control section 14 determines whether the toner concentration is higher or lower than a standard based on the signal. The control section 14 sends a drive signal to the toner cartridge driving section 11 to drive the auger 10 in a case in which the toner concentration is lower than the standard. The auger 10 supplies the decolorable toner in the toner cartridge 9 to the developing device 23 through the toner replenishment path 111.

The toner adhesion amount sensor 12 detects the amount of the toner adhering to the intermediate transfer belt 3. The toner adhesion amount sensor 12 outputs a signal corresponding to the detected toner amount.

The fixing device 13 executes either a print mode or a decoloring mode based on a switch signal of the control section 14. The fixing device 13 heats and presses the paper to which the toner image is transferred to fix the toner image on the paper.

Figure 2:
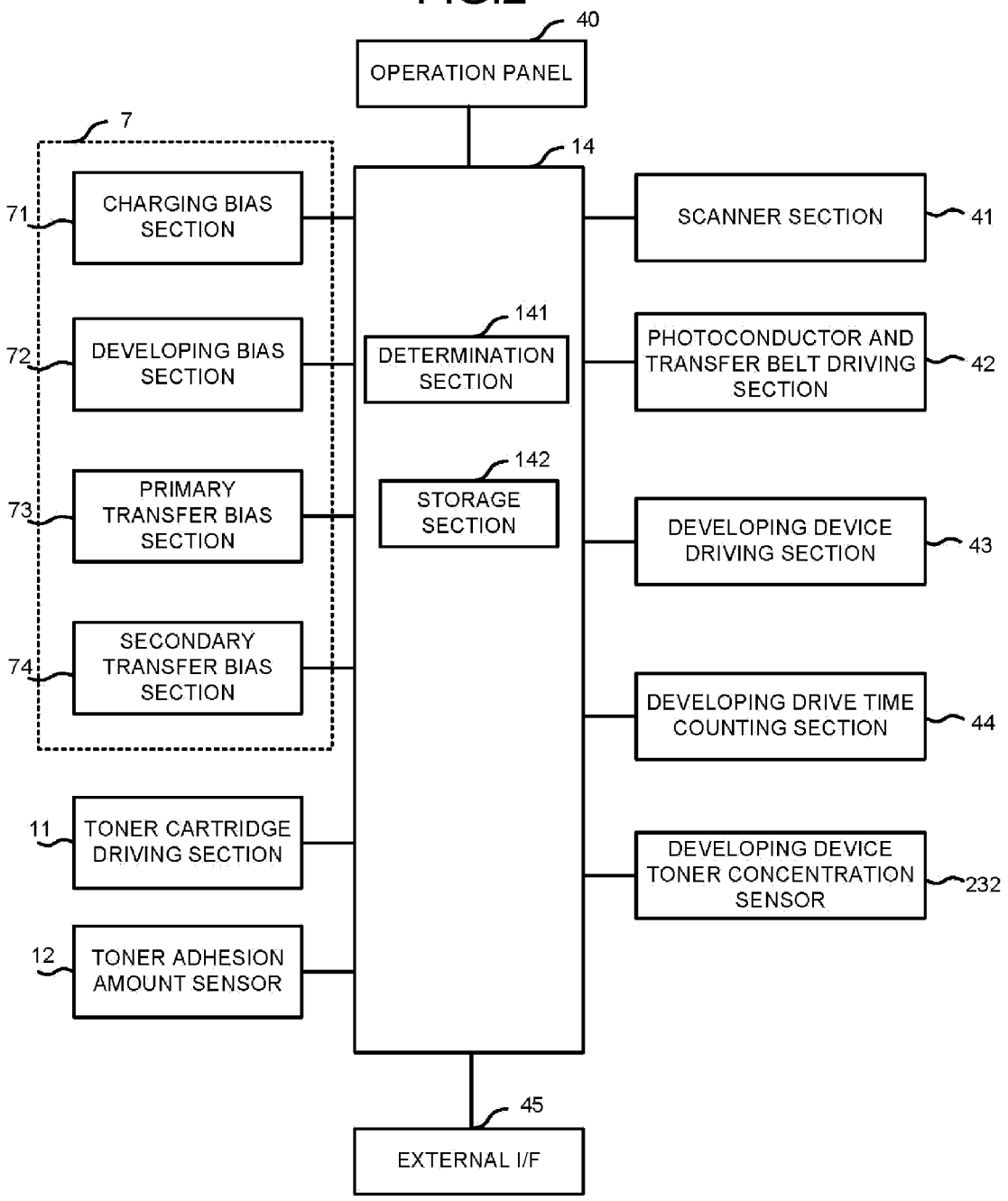
FIG. 2 is a control block diagram illustrating the image forming apparatus according to the first embodiment.

FIG. 2 is a control block diagram illustrating the image forming apparatus 1 according to the embodiment.

The control section 14 controls the operations of the image forming apparatus 1. The control section 14 is connected with the power source part 7, the toner cartridge driving section 11, the toner adhesion amount sensor 12, an operation panel section 40, a scanner section 41, a photoconductor and transfer belt driving section 42, a developing device driving section 43, a developing drive time counting section 44 and an external I/F (interface) 45.

The operation panel section 40 functions as a user interface. The operation panel section 40 outputs, based on an operation from an operator, operation information based on the operation to the control section 14. The operation panel section 40 includes an operation section and a display section. The operation section receives an operation form the operator. The display section displays operation guidance and the like for the operator.

The scanner section 41 acquires image information from a document. The scanner section 41 converts the acquired image information into image data and then outputs the image data to the control section 14.

The photoconductor and transfer belt driving section 42 receives a first drive signal from the control section 14. The photoconductor and transfer belt driving section 42, if receiving the first drive signal, drives the photoconductive drum 21 and the intermediate transfer belt 3.

The developing device driving section 43 receives a second drive signal from the control section 14. The developing device driving section 43, if receiving the second drive signal, drives the developing roller 231.

The power source part 7 includes a charging bias section 71, a developing bias section 72, a primary transfer bias section 73 and a secondary transfer bias section 74.

The charging bias section 71, if receiving a first bias signal from the control section 14, uniformly charges the surface of the photoconductive drum 21.

The developing bias section 72, if receiving a second bias signal from the control section 14, applies a developing bias to the developing roller 231.

The primary transfer bias section 73, if receiving a third bias signal from the control section 14, applies a primary transfer bias to the primary transfer roller 6.

The secondary transfer bias section 74, if receiving a fourth bias signal from the control section 14, applies a secondary transfer bias to the roller facing the secondary transfer roller 8.

The developing drive time counting section 44 counts the time (hereinafter referred to as a "developing drive time") during which the developing device 23 is operating. The developing drive time counting section 44 outputs the counted developing drive time to the control section 14.

The external I/F 45 receives the image data sent from an external machine such as a PC and the like. The external I/F 45 outputs the received image data to the control section 14.

The control section 14 receives the operation information from the operation panel section 40. The control section 14 executes either the print mode or the decoloring mode based on the operation information. The print mode is a mode for heating, pressing and fixing the paper to which the toner image is transferred to print the image on the paper. The decoloring mode is a mode for heating the paper printed with the decolorable toner to decolor the image on the paper.

The control section 14 calculates the toner adhesion amount according to the signal corresponding to the toner amount. The control section 14 controls to feedback image forming conditions such as the developing bias and the like on the basis of the calculated toner adhesion amount.

The control section 14 includes a determination section 141 and a storage section 142.

The determination section 141 acquires the developing drive time from the developing drive time counting section 44 in an idling operation mode of the developing device 23. In the idling operation mode, the developing device 23 is driven for a given time without adhering the toner to the photoconductive drum 21. The control section 14 operates the idling operation mode. In a case in which the time of the idling operation mode is long, the contamination of the decolorable toner due to the carrier is worsened. Thus, the developing drive time is a parameter indicating the deterioration degree of the decolorable toner. The determination section 141 acquires a first threshold value from the storage section 142. The determination section 141 executes a toner refreshing operation in a case in which the acquired developing drive time is greater than a first threshold value.

The toner refreshing operation is an operation for discharging the contaminated decolorable toner in the developing device 23 by forming the predetermined toner image on the photoconductive drum 21. For example, the idling operation mode of the developing device 23 includes a mode for the execution of auto toner adjustment, decoloring mode and waiting mode for waiting to complete necessary processing or preparing for the printing. While these mode is executed, the printing is held. The auto toner adjustment refers to adjusting the toner concentration sensor 232 of the developing device 23. For example, the waiting mode refers to waiting time until RIP processing (raster image processing), operation for stand-by of the fixing device, or secondary transfer cleaning operation is completed.

Hereinafter, the toner refreshing operation is described.

The control section 14 forms a given toner image (hereinafter referred to as a "refresh pattern") on the photoconductive drum 21. No specific limitation is given to the given toner image as long as the contaminated decolorable toner in the developing device 23 can be collected. For example, the given toner image is a full solid image. The control section 14 transfers the given toner image to the intermediate transfer belt 3. At this time, the paper is not fed to the secondary transfer roller 8. Thus, the transferred decolorable toner is collected by the transfer belt cleaner 200.

Figure 3B:
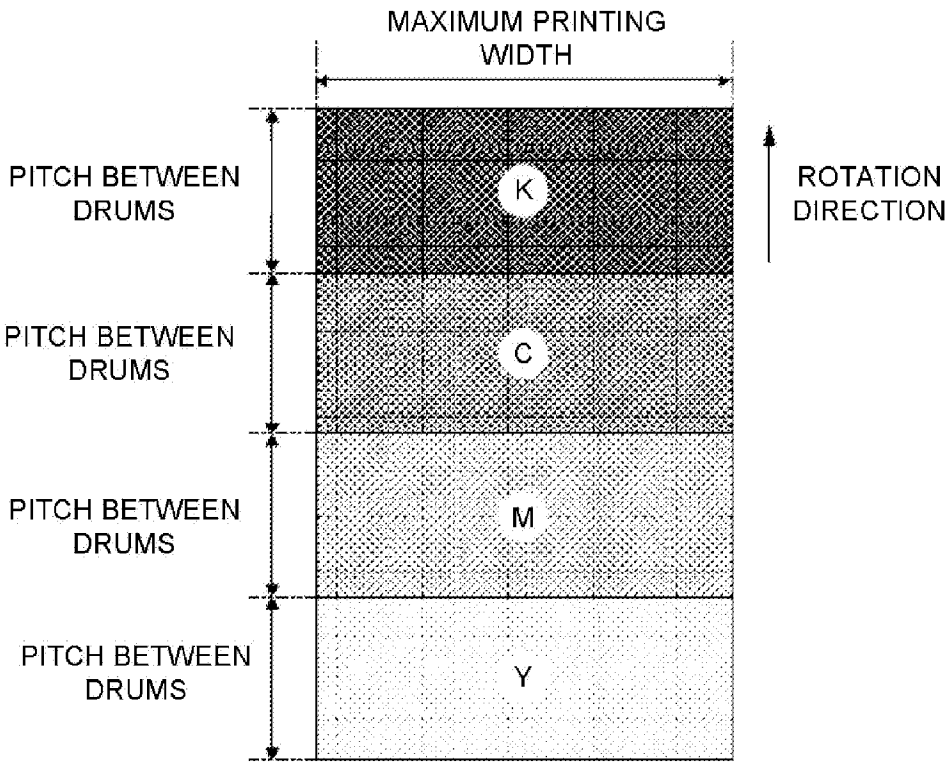
FIG. 3B is a diagram illustrating an example of a refresh pattern of decolorable toner of four colors to be transferred to the intermediate transfer belt 3.
Figure 3A:
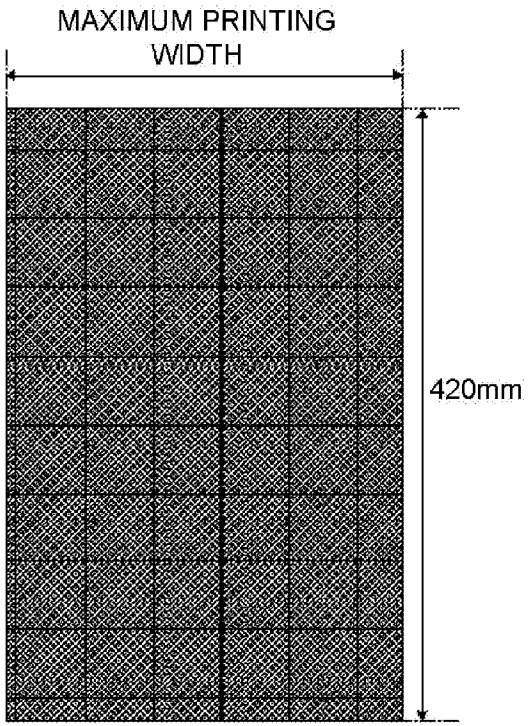
FIG. 3A is a diagram illustrating an example of a refresh pattern of decolorable toner of a single color to be transferred to an intermediate transfer belt 3.

FIG. 3 is a diagram illustrating an example of the refresh pattern transferred to the intermediate transfer belt 3 in the toner refreshing operation. FIG. 3A is a diagram illustrating an example of the refresh pattern transferred to the intermediate transfer belt 3 in a case of using the decolorable toner of a single color. FIG. 3B is a diagram illustrating an example of the refresh pattern transferred to the intermediate transfer belt 3 in a case of using the decolorable toner of four colors. In addition, the entire solid of the decolorable toner of four colors may be superimposed. Further, in a case of a mechanism in which the secondary transfer roller 8 can be separated from the intermediate transfer belt 3, the control section 14 can separate the secondary transfer roller 8 from the intermediate transfer belt 3 until the refresh pattern passes through the nip between the secondary transfer roller 8 and the intermediate transfer belt 3. On the other hand, in a case in which the secondary transfer roller 8 cannot be separated from the intermediate transfer belt 3, the control section 14 applies an electric field to the roller opposite to the secondary transfer roller 8 so that the decolorable toner is moved to the intermediate transfer belt 3. In this way, the contamination of the secondary transfer member when the refresh pattern passes through the secondary transfer roller 8 can be minimized.

The number of times to print the refresh pattern (hereinafter referred to as "printing times threshold value") is stored in the storage section 142 in advance. The control section 14 reads the printing times threshold value from the storage section 142. The control section 14 transfers the refresh pattern to the intermediate transfer belt 3 until the printing times of the refresh pattern is greater than the printing times threshold value. After the transfer operation is completed, the control section 14 drives the toner cartridge driving section 11. The auger 10 supplies the decolorable toner in the toner cartridge 9 to the developing device 23 through the toner replenishment path 111. In this way, the decolorable toner contaminated by the magnetic carrier is collected by the transfer belt cleaner. Then the developing device 23 is replenished with the decolorable toner that is not contaminated.

Figure 4:
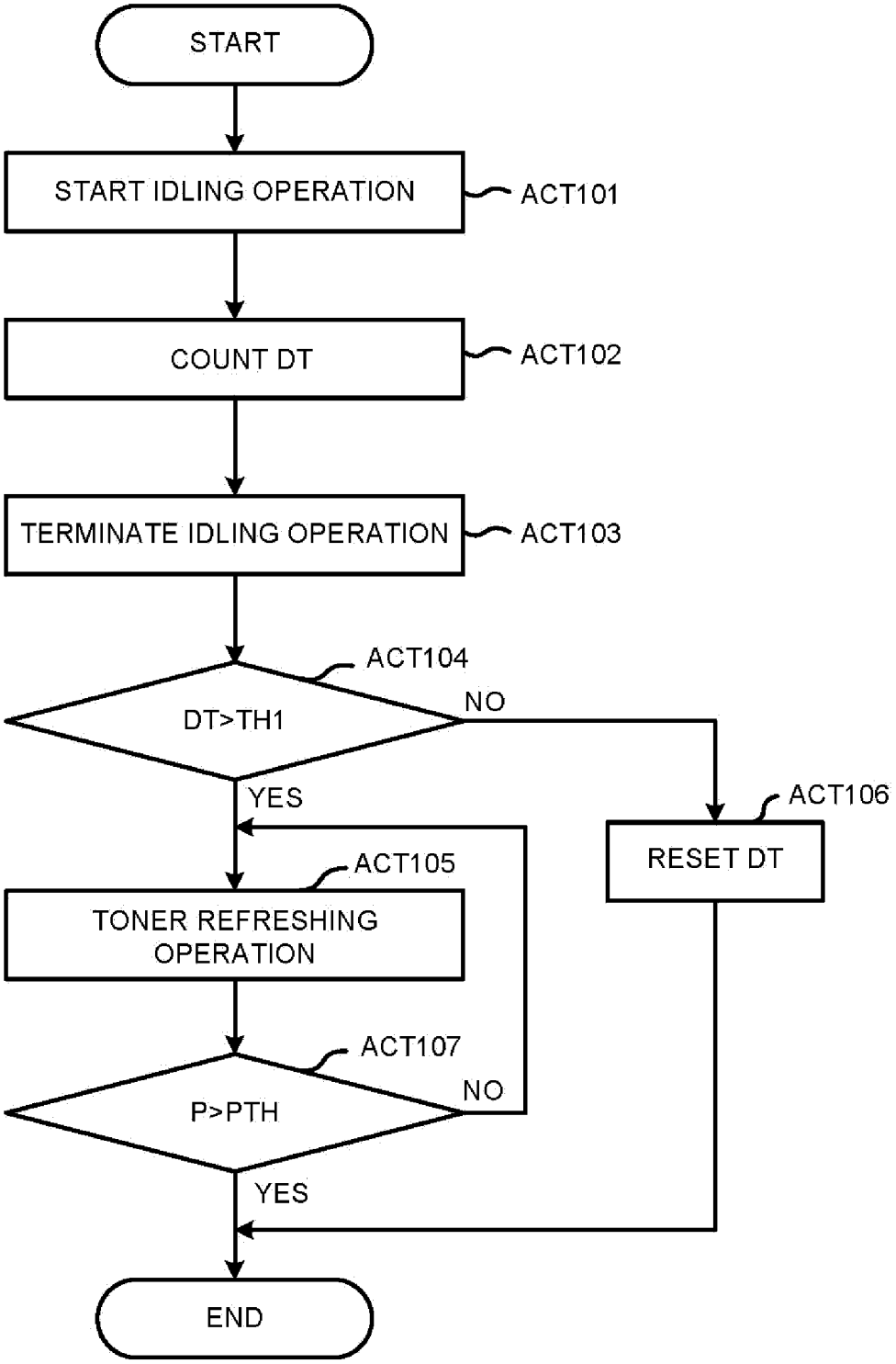
FIG. 4 is a diagram illustrating a timing operation of executing a toner refreshing operation of the image forming apparatus according to the first embodiment.

Next, the timing operation of executing the toner refreshing operation in a case in which the developing device 23 is idled is described with reference to the accompanying drawings. FIG. 4 is a diagram illustrating the timing operation of executing the toner refreshing operation during the auto toner adjustment.

The control section 14 starts the idling operation mode of the developing device 23 (ACT 101).

The developing drive time counting section 44 counts the developing drive time DT (ACT 102).

The control section 14 terminates the idling operation mode of the developing device 23 (ACT 103). The developing drive time counting section 44 outputs the counted developing drive time DT to the determination section 141.

The determination section 141 acquires a first threshold value TH1 from the storage section 142. The determination section 141 determines whether or not the acquired developing drive time DT is greater than the first threshold value TH1 (ACT 104). In a case in which the developing drive time DT is greater than the first threshold value TH1 (YES in ACT 104), the control section 14 executes the toner refreshing operation (ACT 105). On the other hand, in a case in which the developing drive time DT is not greater than the first threshold value TH1 (NO in ACT 104), the developing drive time DT is reset (ACT 106).

The control section 14 reads the printing times threshold value PTH from the storage section 142. The control section 14 determines whether or not the printing times P of the toner refreshing operation is greater than the printing times threshold value PTH (ACT 107). In a case in which the printing times P of the toner refreshing operation is greater than the printing times threshold value PTH (YES in ACT 107), the toner refreshing operation is terminated. In a case in which the printing times P of the toner refreshing operation is not greater than the printing times threshold value PTH (NO in ACT 107), the toner refreshing operation is executed again (ACT 105).

In the embodiment described above, the toner refreshing operation is executed based on the developing drive time, however, the present invention is not limited to this. For example, in a case in which it is pre-determined that the drive time of the idling operation mode is greater than the developing drive time, the toner refreshing operation may be executed after the idling operation mode is terminated.

A Second Embodiment

Figure 5:
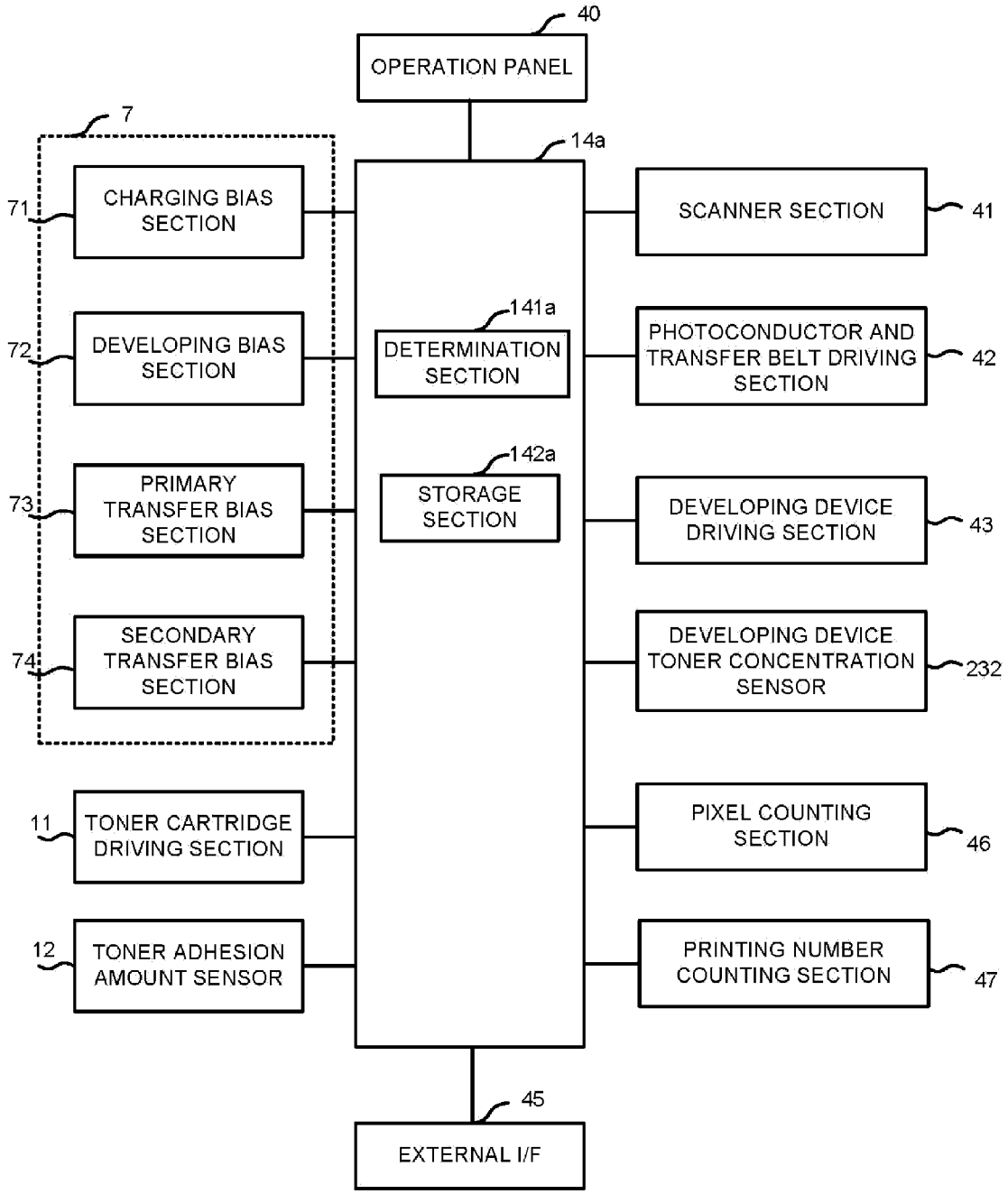
FIG. 5 is a control block diagram illustrating an image forming apparatus according to a second embodiment.

Hereinafter, an image forming apparatus according to the second embodiment is described with reference to the accompanying drawings. FIG. 5 is a control block diagram illustrating an image forming apparatus 1*a* according to the second embodiment. A control section 14*a* of the image forming apparatus 1*a* according to the second embodiment is used instead of the control section 14 in the first embodiment. In addition, the same components as those described in the first embodiment are indicated by the same reference numerals, and the repetitive description is not provided.

The control section 14*a* is connected with the power source part 7, the toner cartridge driving section 11, the toner adhesion amount sensor 12, the operation panel section 40, the scanner section 41, the photoconductor and transfer belt driving section 42, the developing device driving section 43, a pixel counting section 46, a printing number counting section 47 and the external I/F (interface) 45.

The pixel counting section 46 counts the number of pixels (hereinafter referred to as "printing pixel number") of the printed image for each sheet of paper. The pixel counting section 46 outputs the printing pixel number to the control section 14*a*.

The printing number counting section 47 counts the number of printed paper (hereinafter referred to as "printing number"). The printing number counting section 47 outputs the printing number to the control section 14*a*.

The control section 14*a* includes a determination section 141*a* and a storage section 142*a*.

The determination section 141*a* determines whether or not the printing rate is low for each given printing number after the print mode is completed. If the printing is continued in a state in which the printing rate is low, the frequency of the replacement of the toner is low, thus, the deterioration of the toner is worsened. Thus, the average printing rate of the given number is a parameter indicating the deterioration degree of the decolorable toner. For example, the determination section 141*a* acquires the printing number from the printing number counting section 47, acquires the printing pixel number from the pixel counting section 46, and acquires a second threshold value from the storage section 142*a*. The determination section 141*a* calculates a printing rate Cp in a case in which the acquired printing number is greater than the second threshold value. The printing rate Cp is a value obtained by dividing the printing pixel number by the printing number. The determination section 141*a* acquires a third threshold value from the storage section 142*a*. The determination section 141*a* determines that the printing rate is low in a case in which the printing rate Cp is smaller than the third threshold value. The control section 14*a* executes the toner refreshing operation in a case in which it is determined that the printing rate Cp is low.

Figure 6:
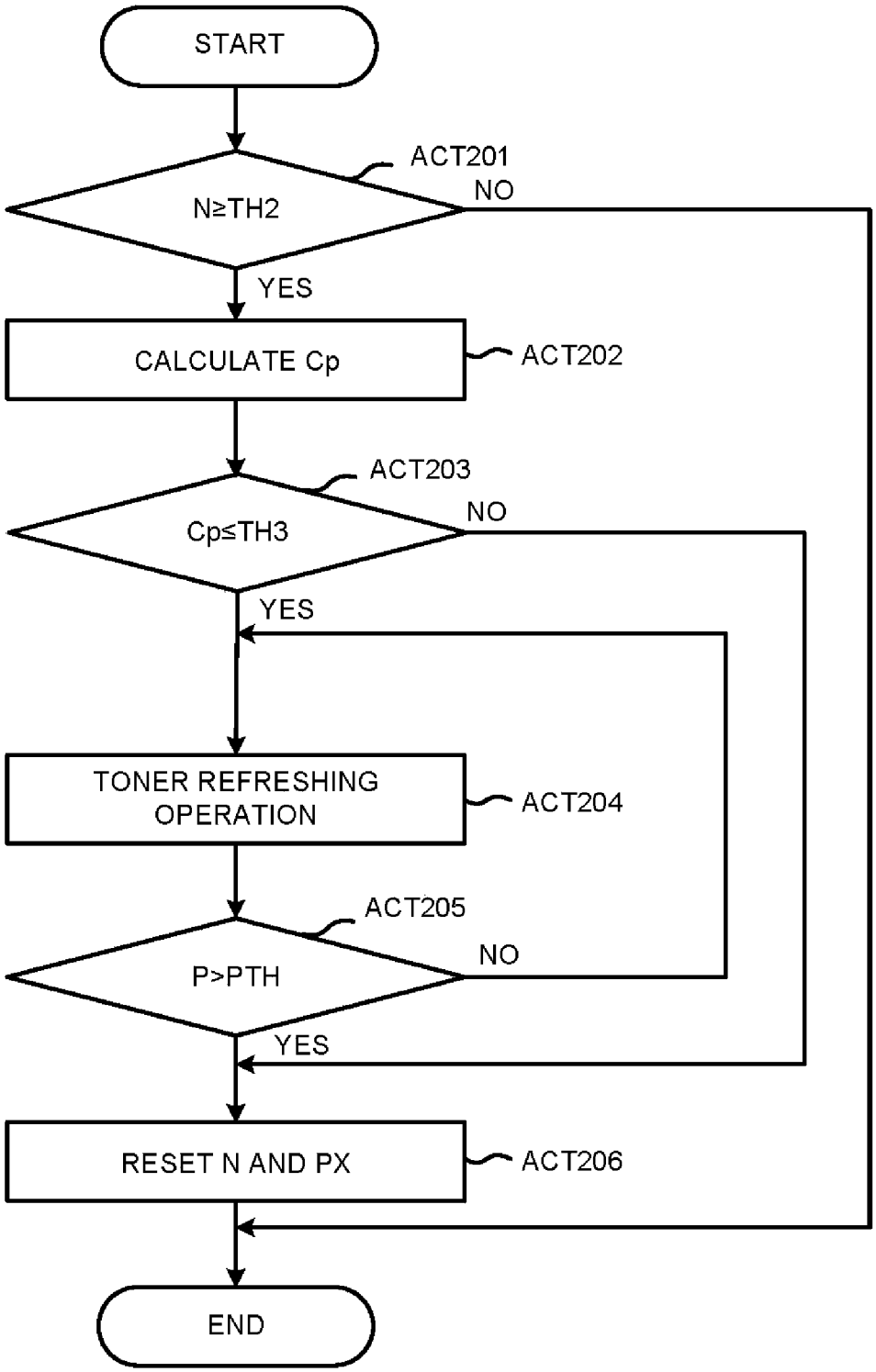
FIG. 6 is a diagram illustrating a timing operation of executing a toner refreshing operation of the image forming apparatus according to the second embodiment.

Next, the timing operation of executing the toner refreshing operation according to the second embodiment after the print mode is completed is described with reference to the accompanying drawings. FIG. 6 is a diagram illustrating the timing operation of executing the toner refreshing operation according to the second embodiment.

After the print mode is completed, the determination section 141*a* determines whether or not the printing number N is greater than the second threshold value TH2 (ACT 201). In a case in which the printing number N is greater than the second threshold value TH2 (YES in ACT 201), the determination section 141*a* calculates the printing rate Cp (ACT 202). In a case in which the printing number N is not greater than the second threshold value TH2 (NO in ACT 201), the control section 14*a* does not execute the toner refreshing operation.

The determination section 141*a* determines whether or not the printing rate Cp is smaller than the third threshold value TH3 (ACT 203). In a case in which the printing rate Cp is smaller than the third threshold value TH3 (YES in ACT 203), the control section 14*a* executes the toner refreshing operation (ACT 204). In a case in which the printing rate Cp is greater than the third threshold value TH3 (NO in ACT 203), the control section 14*a* resets the printing number N and the printing pixel number (ACT 206).

The control section 14*a* reads the printing times threshold value PTH from the storage section 142*a*. The control section 14*a* determines whether or not the printing times P of the toner refreshing operation is greater than the printing times threshold value PTH (ACT 205). In a case in which the printing times P of the toner refreshing operation is greater than the printing times threshold value PTH (YES in ACT 205), the control section 14*a* resets the printing number N and the printing pixel number PX (ACT 206). In a case in which the printing times P of the toner refreshing operation is not greater than the printing times threshold value PTH (NO in ACT 205), the toner refreshing operation is executed again (ACT 204).

A Third Embodiment

Figure 7:
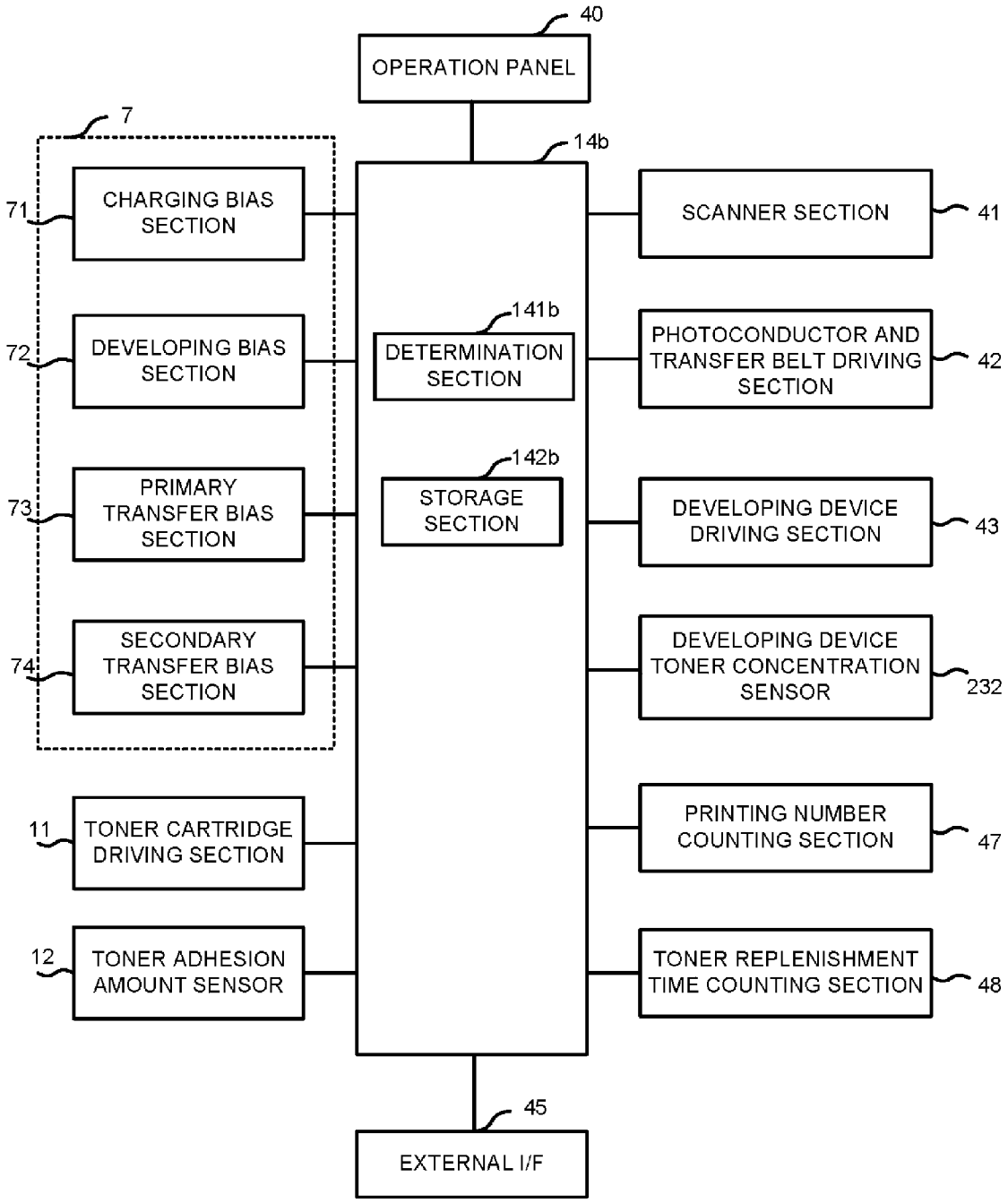
FIG. 7 is a control block diagram illustrating an image forming apparatus according to a third embodiment.

Hereinafter, an image forming apparatus according to the third embodiment is described with reference to the accompanying drawings. FIG. 7 is a control block diagram illustrating an image forming apparatus 1*b* according to the third embodiment. A control section 14*b* of the image forming apparatus 1*b* according to the third embodiment is used instead of the control section 14 in the first embodiment. In addition, the same components as those described in the first and the second embodiments are indicated by the same reference numerals, and the repetitive description is not provided.

The control section 14*b* is connected with the power source part 7, the toner cartridge driving section 11, the toner adhesion amount sensor 12, the operation panel section 40, the scanner section 41, the photoconductor and transfer belt driving section 42, the developing device driving section 43, the printing number counting section 47, a toner replenishment time counting section 48 and the external I/F (interface) 45.

The toner replenishment time counting section 48 counts the time (hereinafter referred to as "toner replenishment time") when the developing device 23 is replenished with the decolorable toner. For example, the toner replenishment time is the drive time of the toner cartridge driving section 11. The toner replenishment time counting section 48 outputs the toner replenishment time to the control section 14*b*.

The control section 14*b* includes a determination section 141*b* and a storage section 142*b*.

The determination section 141*b* determines whether or not the toner replenishment time is short for each given printing number after the print mode is completed. If the toner replenishment time of each given number is short, the frequency of the replacement of the decolorable toner in the developing device is low, thus, the deterioration of the toner is worsened. Thus, the toner replenishment time of each given number is a parameter indicating the deterioration degree of the decolorable toner. For example, the determination section 141*b* acquires the printing number from the printing number counting section 47, acquires the toner replenishment time from the toner replenishment time counting section 48, and acquires a second threshold value from the storage section 142*b*. The determination section 141*b* determines whether or not the toner replenishment time is short in a case in which the acquired printing number is greater than the second threshold value. The determination section 141*b* acquires a fourth threshold value from the storage section 142*b*. The determination section 141*b* determines that the toner replenishment time is short in a case in which the toner replenishment time is smaller than the fourth threshold value. The control section 14*b* executes the toner refreshing operation in a case in which it is determined that the toner replenishment time is short.

Figure 8:
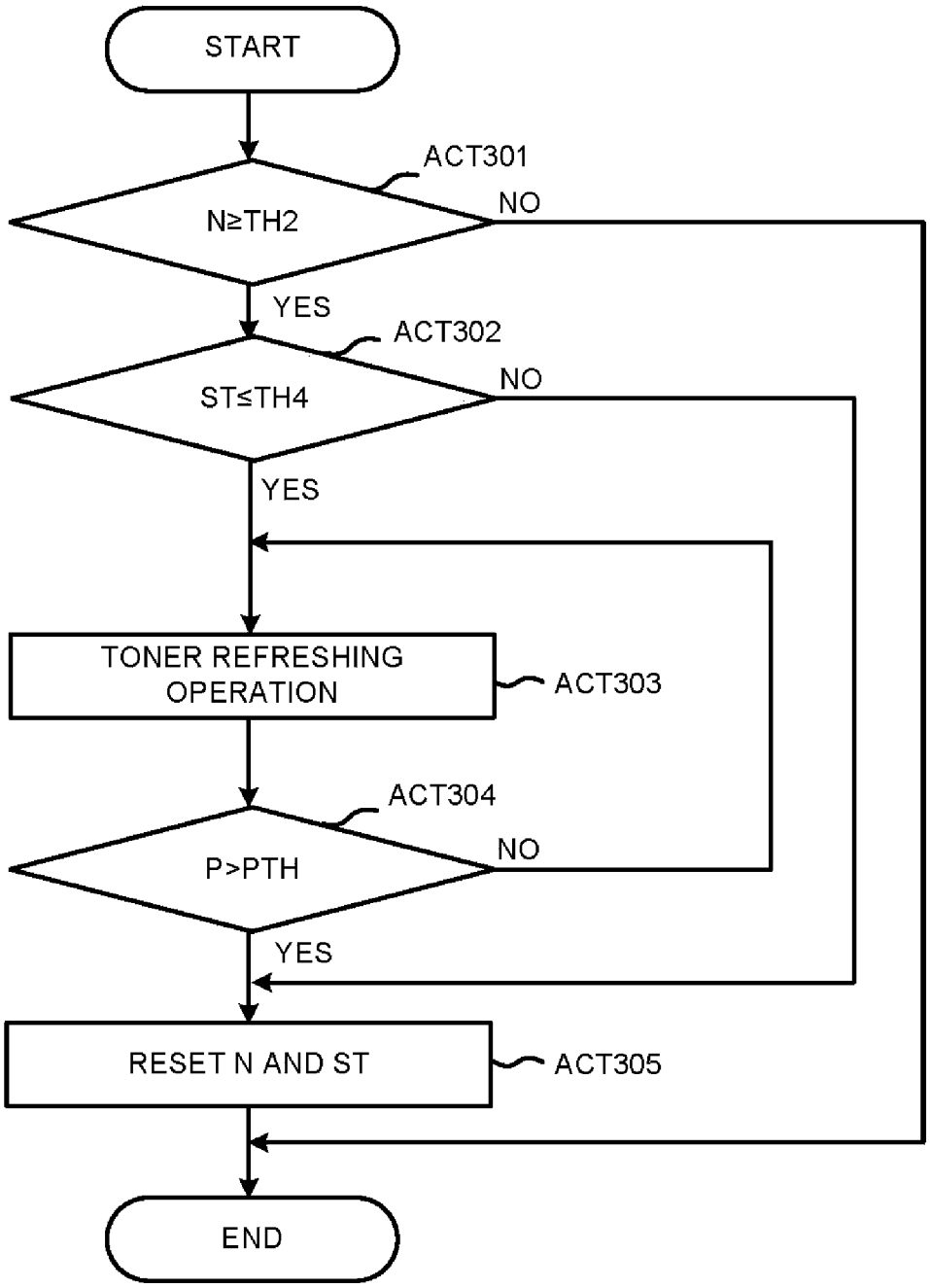
FIG. 8 is a diagram illustrating a timing operation of executing a toner refreshing operation of the image forming apparatus according to the third embodiment.

Next, the timing operation of executing the toner refreshing operation according to the third embodiment after the print mode is completed is described with reference to the accompanying drawings. FIG. 8 is a diagram illustrating the timing operation of executing the toner refreshing operation according to the third embodiment.

After the print mode is completed, the determination section 141*b* determines whether or not the printing number N is greater than the second threshold value TH2 (ACT 301). In a case in which the printing number N is greater than the second threshold value TH2 (YES in ACT 301), the determination section 141*b* determines whether or not the toner replenishment time ST is short. That is, the determination section 141*b* determines whether or not the toner replenishment time ST is smaller than the fourth threshold value TH4 (ACT 302). In a case in which the printing number N is not greater than the second threshold value TH2 (NO in ACT 301), the control section 14*b* does not execute the toner refreshing operation.

In a case in which the toner replenishment time ST is smaller than the fourth threshold value TH4 (YES in ACT 302), the control section 14*b* executes the toner refreshing operation (ACT 303). In a case in which the toner replenishment time ST is greater than the fourth threshold value TH4 (NO in ACT 302), the control section 14*b* resets the printing number N and the toner replenishment time ST (ACT 305).

The control section 14*b* reads the printing times threshold value PTH from the storage section 142*b*. The control section 14*b* determines whether or not the printing times P of the toner refreshing operation is greater than the printing times threshold value PTH (ACT 304). In a case in which the printing times P of the toner refreshing operation is greater than the printing times threshold value PTH (YES in ACT 304), the control section 14*b* resets the printing number N and the toner replenishment time ST (ACT 305). In a case in which the printing times P of the toner refreshing operation is not greater than the printing times threshold value PTH (NO in ACT 304), the toner refreshing operation is executed again (ACT 303).

A Fourth Embodiment

Figure 9:
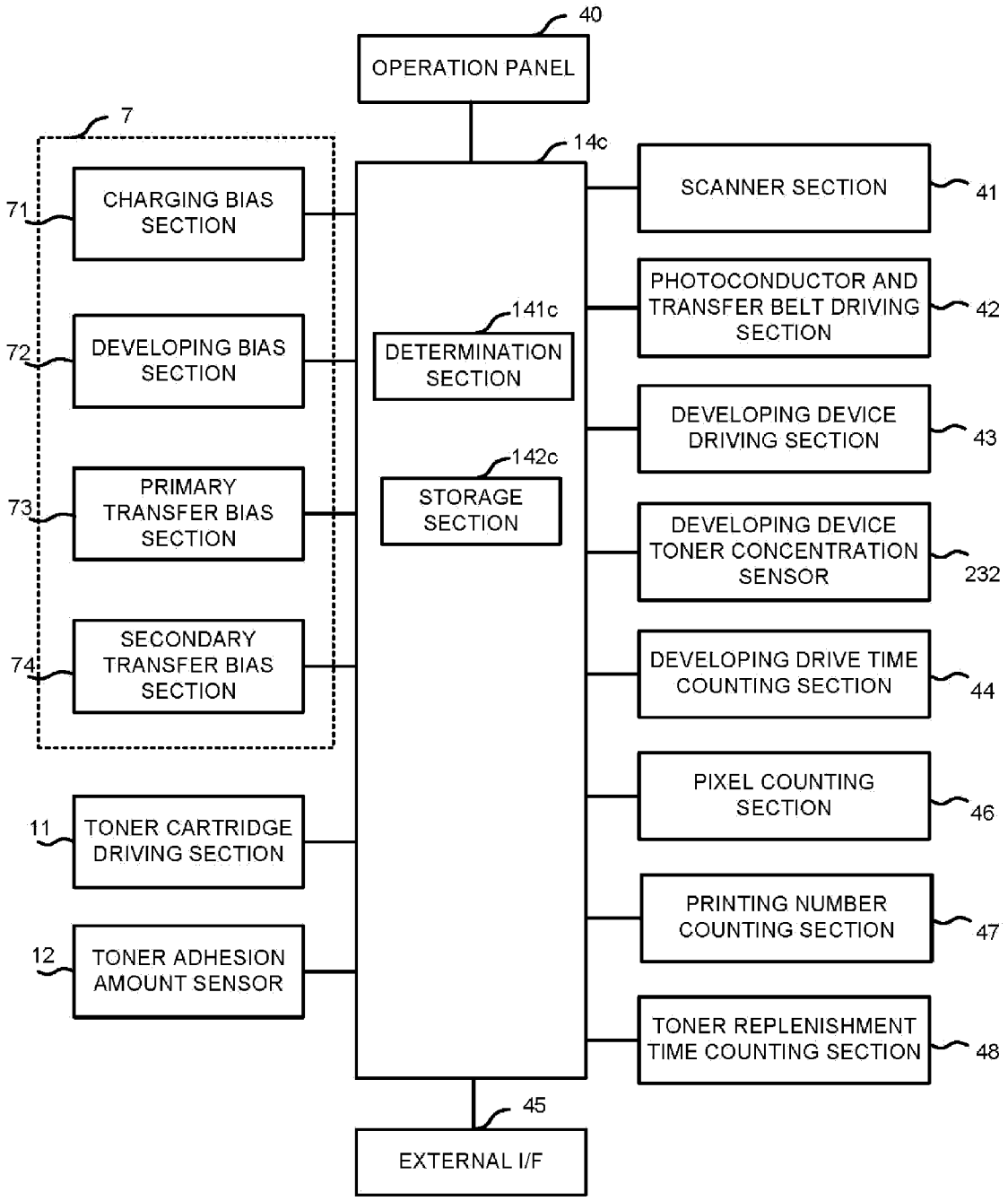
FIG. 9 is a control block diagram illustrating an image forming apparatus according to a fourth embodiment.

Hereinafter, an image forming apparatus according to the fourth embodiment is described with reference to the accompanying drawings. FIG. 9 is a control block diagram illustrating an image forming apparatus 1*c* according to the fourth embodiment. A control section 14*c* of the image forming apparatus 1*c* according to the fourth embodiment is used instead of the control section 14 in the first embodiment. In addition, the same components as those in the embodiments described above are indicated by the same reference numerals, and the repetitive description is not provided.

The control section 14*c* is connected with the power source part 7, the toner cartridge driving section 11, the toner adhesion amount sensor 12, the operation panel section 40, the scanner section 41, the photoconductor and transfer belt driving section 42, the developing device driving section 43, the developing drive time counting section 44, the pixel counting section 46, the printing number counting section 47, the toner replenishment time counting section 48 and the external I/F (interface) 45.

The control section 14*c* includes a determination section 141*c* and a storage section 142*c*.

The determination section 141*c* calculates an idling rate Dd and an idling rate Dp of the developing device 23 for each given printing number after the print mode is completed. The idling rate Dd and the idling rate Dp are parameters indicating the deterioration degree of the decolorable toner. For example, the determination section 141*c* acquires the developing drive time from the developing drive time counting section 44, acquires the printing pixel number from the pixel counting section 46, and acquires the toner replenishment time from the toner replenishment time counting section 48. The determination section 141*c* divides the developing drive time by the toner replenishment time to calculate the idling rate Dd. The determination section 141*c* divides the developing drive time by the printing pixel number to calculate the idling rate Dp.

The determination section 141*c* acquires a fifth threshold value from the storage section 142*c*. The determination section 141*c* determines that the deterioration of the decolorable toner is worsened in a case in which the acquired idling rate Dd is greater than the fifth threshold value. The determination section 141*c* acquires a sixth threshold value from the storage section 142*c*. The determination section 141*c* determines that the deterioration of the decolorable toner is worsened in a case in which the idling rate Dp is greater than the sixth threshold value. The control section 14*c* executes the toner refreshing operation in a case in which it is determined that the deterioration of the decolorable toner is worsened.

Figure 10:
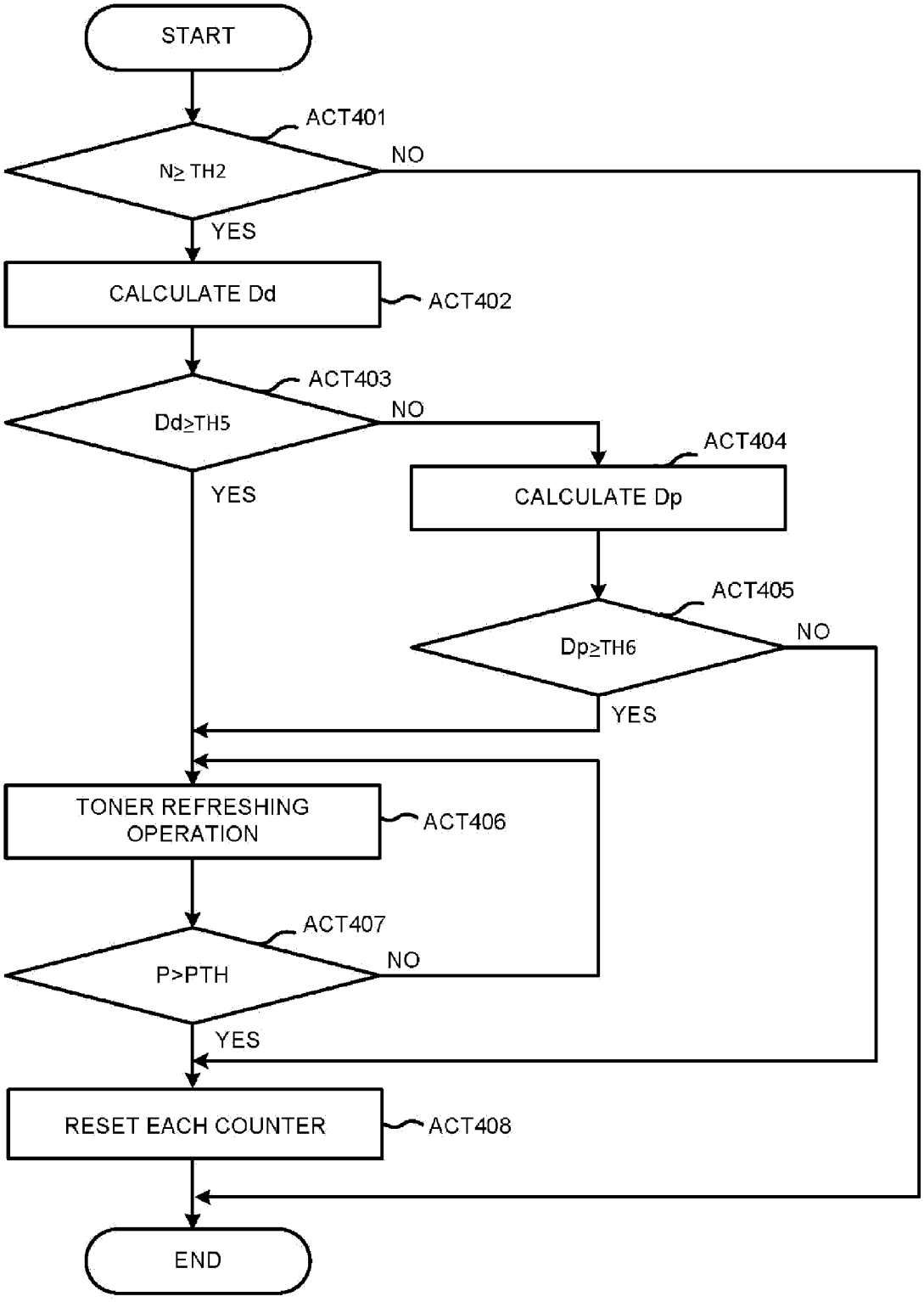
FIG. 10 is a diagram illustrating a timing operation of executing a toner refreshing operation of the image forming apparatus according to the fourth embodiment.

Next, the timing operation of executing the toner refreshing operation according to the fourth embodiment after the print mode is completed is described with reference to the accompanying drawings. FIG. 10 is a diagram illustrating the timing operation of executing the toner refreshing operation according to the fourth embodiment.

After the print mode is completed, the determination section 141*c* determines whether or not the printing number N is greater than the second threshold value TH2 (ACT 401).

In a case in which the printing number N is greater than the second threshold value TH2 (YES in ACT 401), the determination section 141*c* calculates the idling rate Dd (ACT 402). In a case in which the printing number N is not greater than the second threshold value TH2 (NO in ACT 401), the control section 14*c* does not execute the toner refreshing operation.

The determination section 141*c* determines whether or not the idling rate Dd is greater than the fifth threshold value TH5 (ACT 403). In a case in which the idling rate Dd is greater than the fifth threshold value TH5 (YES in ACT 403), the control section 14*c* executes the toner refreshing operation (ACT 406). In a case in which the idling rate Dd is not greater than the fifth threshold value TH5 (NO in ACT 403), the determination section 141*c* calculates the idling rate Dp (ACT 404).

The determination section 141*c* determines whether or not the idling rate Dp is greater than the sixth threshold value TH6 (ACT 405). In a case in which the idling rate Dp is greater than the sixth threshold value TH6 (YES in ACT 405), the control section 14*c* executes the toner refreshing operation (ACT 406). In a case in which the idling rate Dd is not greater than the sixth threshold value TH6 (NO in ACT 405), the control section 14*c* resets each counter (ACT 408). The "each counter" mentioned herein includes the developing drive time DT, the printing number N, the printing pixel number PX and the toner replenishment time ST.

The control section 14*c* reads the printing times threshold value PTH from the storage section 142*c*. The control section 14*c* determines whether or not the printing times P of the toner refreshing operation is greater than the printing times threshold value PTH (ACT 407). In a case in which the printing times P of the toner refreshing operation is greater than the printing times threshold value PTH (YES in ACT 407), the control section 14*c* resets each counter (ACT 408). In a case in which the printing times P of the toner refreshing operation is not greater than the printing times threshold value PTH (NO in ACT 407), the control section 14*c* executed the toner refreshing operation again (ACT 406).

In accordance with at least one embodiment described above, the image forming apparatus is provided with the developing device, the cleaner and the control section. The developing device stores the decolorable toner. The developing device adheres the stored decolorable toner to the photoconductor to form a given toner image. The cleaner collects the decolorable toner of the toner image. The control section forms a toner image on the photoconductor through the developing device based on the parameter indicating the use amount of the decolorable toner. In this way, the decolorable toner contaminated because of being stirred together with the magnetic carrier can be discharged. Then the decolorable toner that is not contaminated is supplied after the contaminated decolorable toner is discharged, thus, printing can be carried out with the decolorable toner that is not contaminated.

In the embodiments described above, the image forming apparatus may be or may not be an intermediate transfer type image forming apparatus. The image forming apparatus that is not an intermediate transfer type does not use the intermediate transfer belt. In this case, as the refresh pattern, the toner developed on the photoconductive drum is collected by a photoconductor cleaner. In this way, the contaminated toner in the developing device is discharged to the outside of the developing device. Further, if an electric field is applied to the transfer section to move the decolorable toner to the photoconductive drum at this time, the contamination of the transfer roller can be minimized.

Furthermore, in the embodiment described above, the idling operation mode may be executed by an idling operation section instead of the control section.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus comprising:

a developing device configured to store decolorable toner and to develop a latent image formed on a photoconductor with the decolorable toner;

a control section configured to form a predetermined toner image on the photoconductor by the developing device based on a parameter indicating a deterioration degree of the decolorable toner;

a cleaner configured to collect the predetermined toner image formed on the photoconductor;

wherein the parameter is a printing rate which is calculated by dividing total number of pixels of images formed on an image receiving media by total number of the image receiving media during a predetermined number of image forming; and wherein the control section forms the predetermined toner image on the photoconductor by the developing device when the printing rate is smaller than a predetermined threshold value.

2. The image forming apparatus according to claim 1, further comprising:

replenishing section to replenish the developing device with the decolorable toner after predetermined toner image is formed on the photoconductor by the developing device.

3. The image forming apparatus according to claim 1, wherein the predetermined toner image is a solid image.

4. The image forming apparatus according to claim 1, wherein the developing device stores the developing agent containing the decolorable toner and the magnetic carrier covered by coating agent containing conductive agent.

5. An image forming apparatus comprising:

a developing device configured to store decolorable toner and to develop a latent image formed on a photoconductor with the decolorable toner;

a control section configured to form a predetermined toner image on the photoconductor by the developing device based on a parameter indicating a deterioration degree of the decolorable toner;

a cleaner configured to collect the predetermined toner image formed on the photoconductor;

wherein the parameter is an idling rate, which is calculated by dividing a driving time of the developing device by number of pixels of the images formed on image receiving members during a predetermined number of image forming; and wherein the control section forms the predetermined toner image on the photoconductor by the developing device when the idling rate is greater than a predetermined threshold value.

6. An image forming apparatus comprising:

a developing device configured to store decolorable toner and to develop a latent image formed on a photoconductor with the decolorable toner;

a control section configured to form a predetermined toner image on the photoconductor by the developing device based on a parameter indicating a deterioration degree of the decolorable toner;

a cleaner configured to collect the predetermined toner image formed on the photoconductor;

a replenishing section to replenish the developing device with the decolorable toner after predetermined toner image is formed on the photoconductor by the developing device;

wherein the parameter is an idling rate, which is calculated by dividing a driving time of the developing device by a replenishment time of the decolorable toner by the replenishing section during a predetermined number of image forming; and wherein the control section forms the predetermined toner image on the photoconductor by the developing device when the idling rate is greater than a predetermined threshold value.

* * * * *